US007318790B2

(12) United States Patent
Chuang et al.

(10) Patent No.: US 7,318,790 B2
(45) Date of Patent: Jan. 15, 2008

(54) REVOLUTION COUNTER FOR WRIST EXERCISER

(76) Inventors: Yun Yu Chuang, 4F, No. 16, Alley 15, Lane 82, Da Yong Street, San Chong, Taipei 241 (TW); Ming Hung Lin, 2F, No. 24, Lane 178, Li Shyng Road Section 1, San Chong, Taipei 241 (TW)

( * ) Notice: Subject to any disclaimer, the term of this patent is extended or adjusted under 35 U.S.C. 154(b) by 109 days.

(21) Appl. No.: 11/367,476

(22) Filed: Mar. 6, 2006

(65) Prior Publication Data

US 2007/0207899 A1 Sep. 6, 2007

(51) Int. Cl.
*A63B 23/14* (2006.01)
*A63B 71/00* (2006.01)

(52) U.S. Cl. ..... 482/44; 482/8; 601/33

(58) Field of Classification Search ..... 482/1–8, 482/44–45, 49, 110, 902; 446/242–244, 446/233–236; 601/33, 40
See application file for complete search history.

(56) References Cited

U.S. PATENT DOCUMENTS 5,353,655 A * 10/1994 Mishler ..... 74/5 R
5,800,311 A * 9/1998 Chuang ..... 482/44
6,761,611 B2 * 7/2004 Wood et al. ..... 446/175
6,770,012 B2 * 8/2004 Kuo ..... 482/44
6,816,137 B2 * 11/2004 Leja ..... 345/82
7,086,990 B2 * 8/2006 Chuang et al. ..... 482/8
7,101,315 B2 * 9/2006 Chuang et al. ..... 482/44

* cited by examiner

*Primary Examiner*—Jerome Donnelly
*Assistant Examiner*—Fenn C. Mathew
(74) *Attorney, Agent, or Firm*—Rosenberg, Klein & Lee

(57) ABSTRACT

A revolution counter for wrist exerciser includes a generator module, at least a detection element pair, a wireless transmission module, and wireless receiver. The generator module, the detection elements, and the wireless transmission module are arranged between a rotor and a stationary casing of the wrist exerciser. The rotation of the rotor with respect to the casing induces a voltage in the generator module, which is supplied to the detection elements and the wireless transmission module. The detection elements detect the rotation of the rotor and generate a signal associated with data of the rotation to the wireless transmission module. The wireless transmission module converts the signal into corresponding data and transmits the data in a wireless manner. The wireless receiver receives the data and displays the data in a display device or transmits the data to an external electronic device.

10 Claims, 9 Drawing Sheets

REVOLUTION COUNTER FOR WRIST EXERCISER

BACKGROUND OF THE INVENTION

1. Field of the Invention

The present invention generally relates to an illumination device, and in particular to an illumination device comprised of spherical light-emitting elements or the likes mountable to a garment for illuminating the garment.

2. The Related Art

Wrist exercising balls have been known and widely used to exercise and train the wrist muscles, as well as for rehabilitation purposes. Examples are shown in Taiwan Patent No. 135058 and U.S. Pat. No. 5,800,311. Both references teach a spherical wrist exercising device, which allows a user to exercise his or her wrist muscles by rotating the sphere.

Some of the currently available wrist exercising devices, however, are not equipped with counters. The user, who attempts to precisely schedule a training program, cannot get aware of how much exercise has been done. Although some of the known wrist exercising devices are provided with a counter that is often mounted to an external surface of a casing, such a counter is often bulky, substantially increasing the overall size of the wrist exercising device and making the look of the device poor. Also, undesired resistance is induced by such a counter when the user is playing the exercising device.

Another drawback of the conventional counter for wrist exercisers is that the counter is powered by direct current power source, such as batteries. Running out of power is always a concern of the users who play the wrist exerciser for a long time. Replacing dead battery is also troublesome to the users. A further problem of the conventional counter is that the counter is mounted to the outside surface of the wrist exerciser. This prevents the user to check with the revolutions of the wrist exerciser when the exerciser is being played. In other words, timely access to the information of revolution of the wrist exerciser is very difficult, if not impossible. Such information is not stored for subsequent use or transmitted to other electronic devices. Apparently, such conventional counters are subject to limitations in practical applications.

Thus, it is desired to have a wrist exerciser with a counter that overcomes the above discussed deficiencies of the conventional devices.

SUMMARY OF THE INVENTION

A primary objective of the present invention is to provide a wrist exerciser having a revolution counter, which is composed of a generator module and a pair of revolution detection elements, wherein, by the rotation of the wrist exerciser, the generator module provides electrical power to drive the revolution detection elements to count the revolutions of the wrist exerciser.

Another objective of the present invention is to provide a wrist exerciser comprising a revolution counter that is internally mounted in the device to prevent deterioration of the outside look of the device and also to enhance hand-gripping of the device of a user.

A further objective of the present invention is to provide a wrist exerciser comprising a revolution counter operable in a wireless communication manner, wherein the counter comprises a wireless transmission module arranged inside the wrist exerciser and electrically connected to revolution detection elements for transmission of revolution information in a wireless manner and a wireless receiver that receives and applies the revolution information to an external electronic device, such as a display for directly showing up the revolution information or a data processing device, such as personal computer, mobile phone, personal digital assistant (PDA) for processing and storage of the revolution information for subsequent use.

To achieve the above objectives, in accordance with the present invention, a revolution counter is mounted in a wrist exerciser and comprises a generator module, at least a detection element pair, a wireless transmission module, and wireless receiver. The generator module, the detection elements, and the wireless transmission module are arranged between a rotor and a stationary casing of the wrist exerciser. The rotation of the rotor with respect to the casing induces a voltage in the generator module, which is supplied to the detection elements and the wireless transmission module. The detection elements detect the rotation of the rotor and generate a signal associated with data of the rotation to the wireless transmission module. The wireless transmission module converts the signal into corresponding data and transmits the data in a wireless manner. The wireless receiver receives the data and displays the data in a display device or transmits the data to an external electronic device. As such, a self-powered revolution counter for wrist exerciser can be realized, and wireless transmission of rotation related data can be effected.

BRIEF DESCRIPTION OF THE DRAWINGS

The present invention will be apparent to those skilled in the art by reading the following description of preferred embodiments thereof, with reference to the attached drawings, in which.

DETAILED DESCRIPTION OF THE PREFERRED EMBODIMENTS

Figure 1:
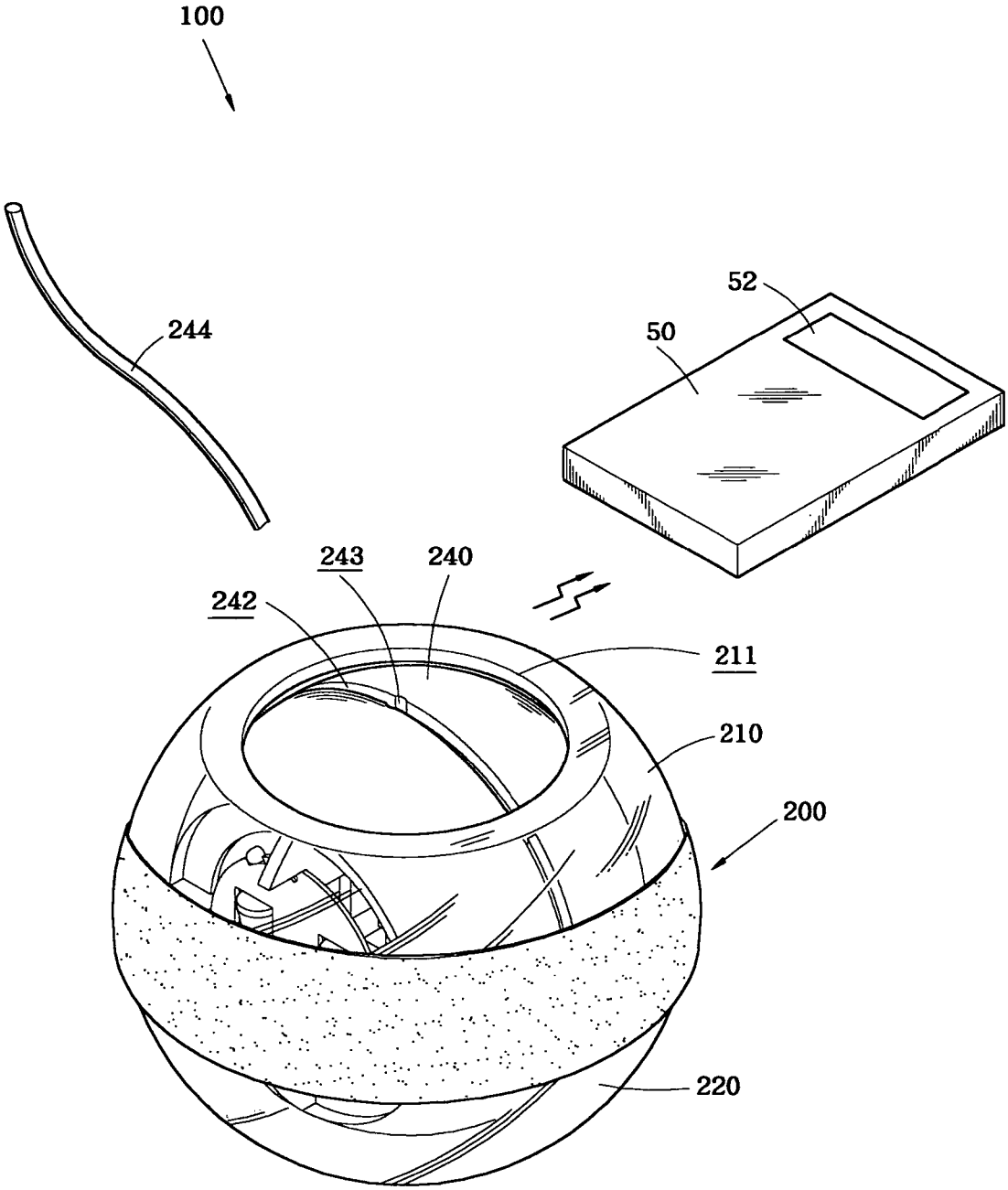
FIG. 1 is a perspective view of a wrist exerciser constructed in accordance with a first embodiment of the present invention.
Figure 2:
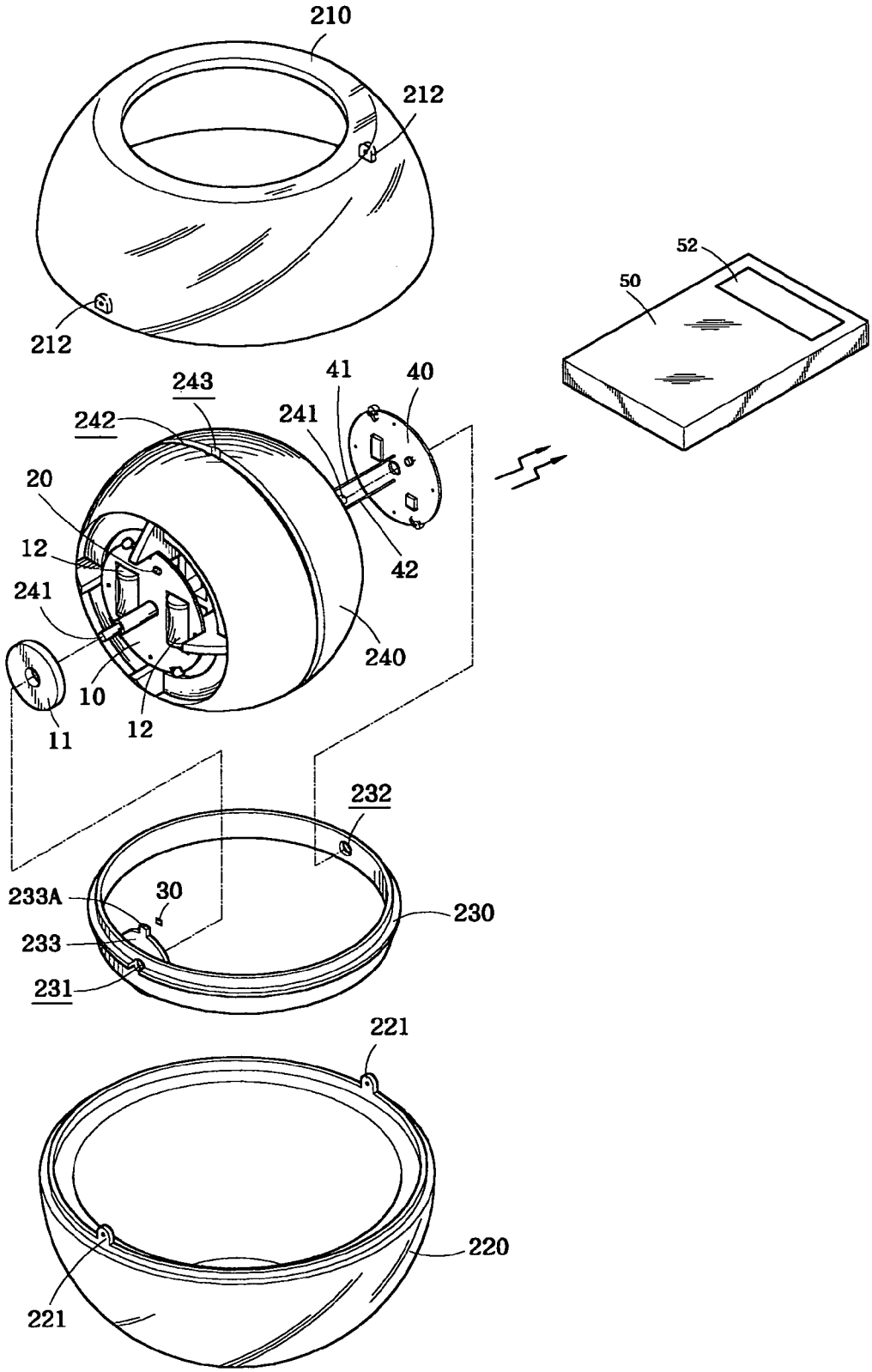
FIG. 2 is an exploded view of the wrist exerciser illustrated in FIG. 1.
Figure 3:
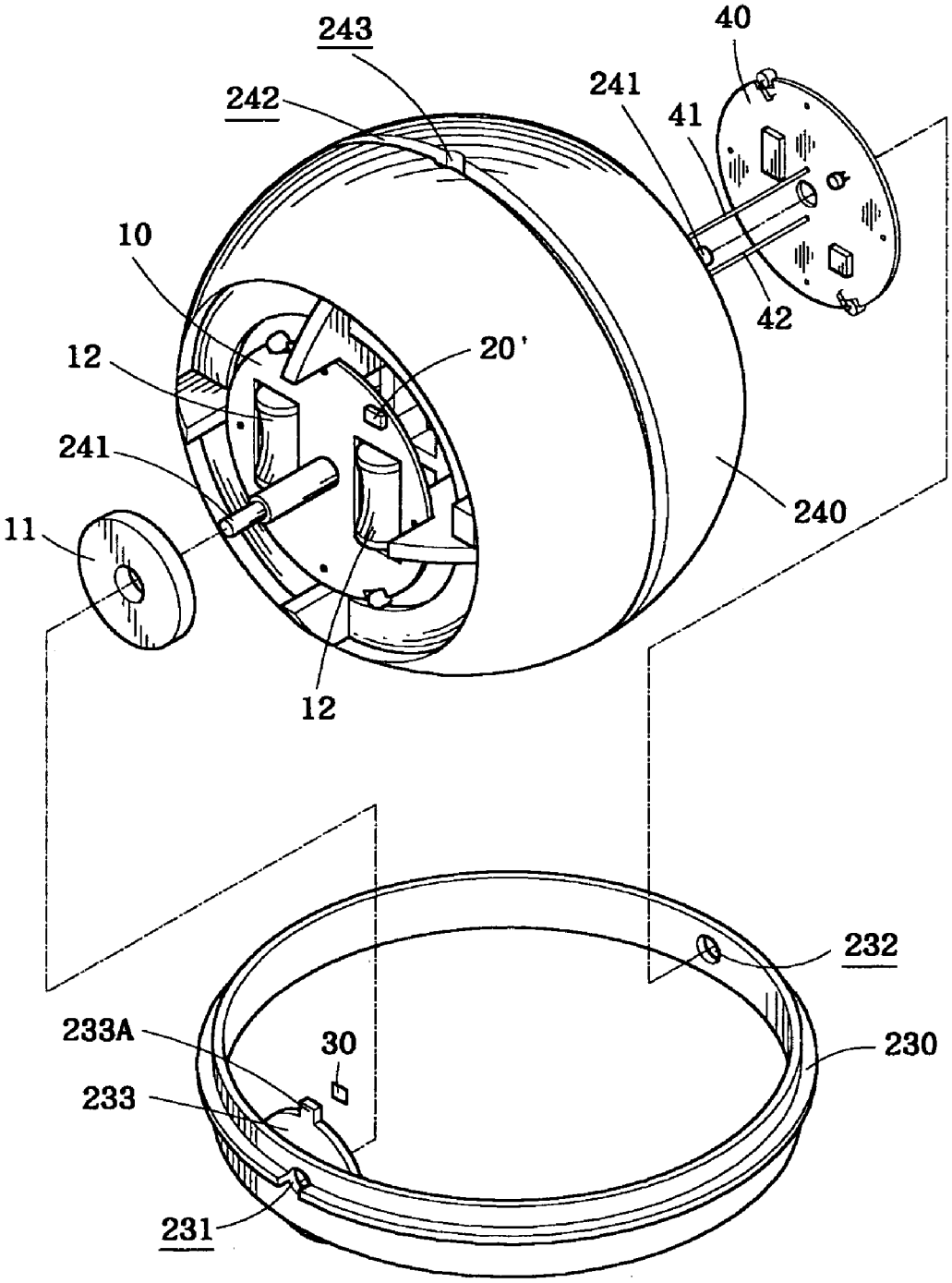
FIG. 3 is a perspective view, in an enlarged scale, showing the spatial relationship among a power generator module, revolution detection elements, wireless transmission module, a rotor and a retention ring of the wrist exerciser of the present invention.
Figure 4:
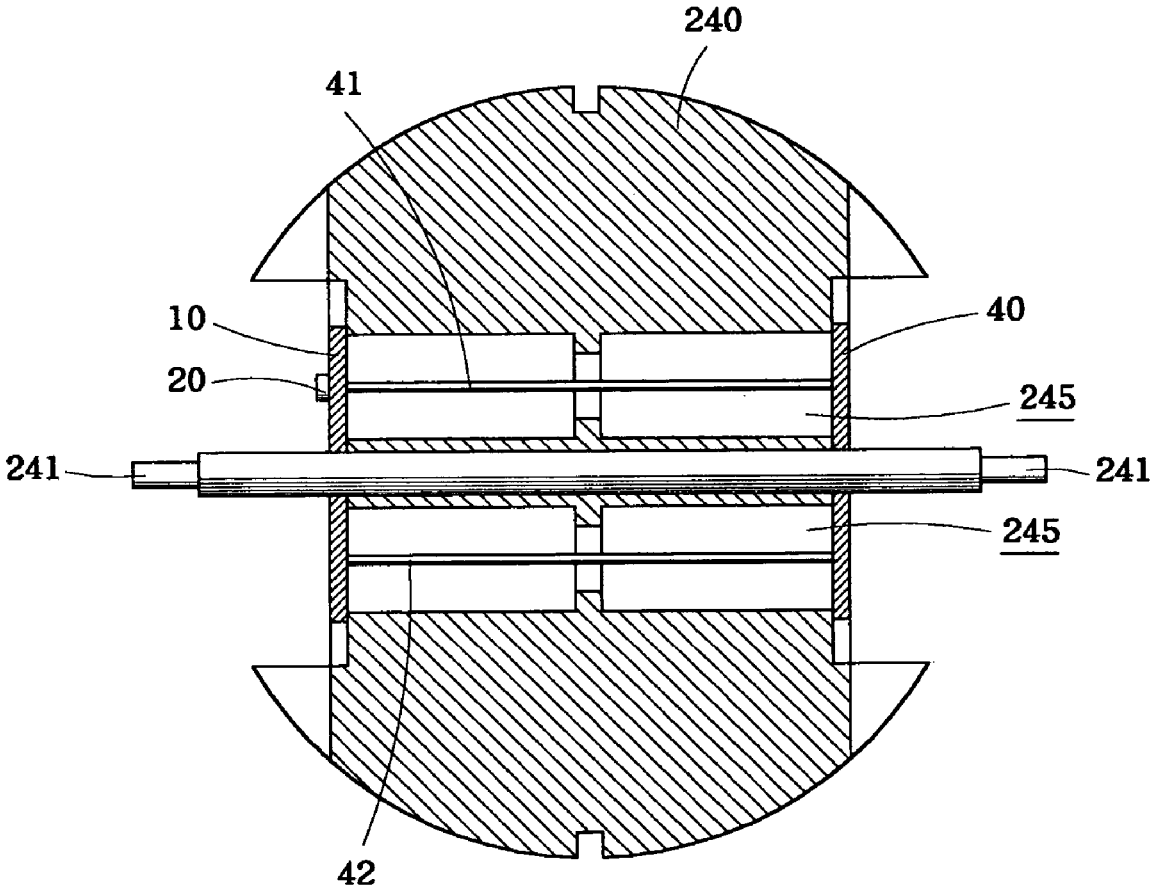
FIG. 4 is a cross-sectional view of the wrist exerciser illustrated in FIG. 1.

With reference to the drawings and in particular to FIGS. 1-4, which shows a wrist exercising device constructed in accordance with a first embodiment of the present invention, the wrist exercising device comprises a wrist exerciser portion generally designated with reference numeral 200, and a revolution counter portion, generally designated with reference numeral 100.

The exerciser 200 comprises a casing made up of upper and lower casing members 210, 220, which are hemispherical shell-like members engageable with each other to form a spherical casing inside which a rotor 240 is rotatably supported. Fastening means 212, 221 is formed on the upper and lower casing members 210, 220 respectively for cooperatively securing the upper and lower casing members 210, 220 together. The upper casing member 210 forms a hole 211 through which the rotor 240 is accessible.

A retention ring 230 is interposed between the upper and lower casing members 210, 220. The retention ring 230 forms two holes 231, 232 exactly opposite to each other about a central axis of the sphere. The rotor 240 has a rotation axle 241 having two ends extending beyond the rotor 240 and rotatably received in the holes 231, 232 of the retention ring 230. This fixes the rotor 240 inside the casing, but allows the rotor 240 to rotate about the rotation axle 241 between the upper and lower casing members 210, 220

A circumferential groove 242 is defined on the rotor 240, substantially opposing the hole 211 of the upper casing member 210. A recessed cavity 243 is formed inside the groove 242. A separate pull string 244 has an inner end extendible into the casing through the hole 211 of the upper casing member 210. The inner end of the string 244 is insertable into and removably fixed in the cavity 243 to allow the string 244 to wind about the rotor 240 by being receivingly extended along the groove 242. By pulling the string 244 off the rotor 240, the rotor 240 is driven by the pulling force and thus rotated inside the casing. Axially extending channels 245 are defined through the rotor 240. All the above description with respect to the wrist exerciser 200 is known and thus further detail that is not related to the novel features of the present invention is not necessary herein.

Figure 5:
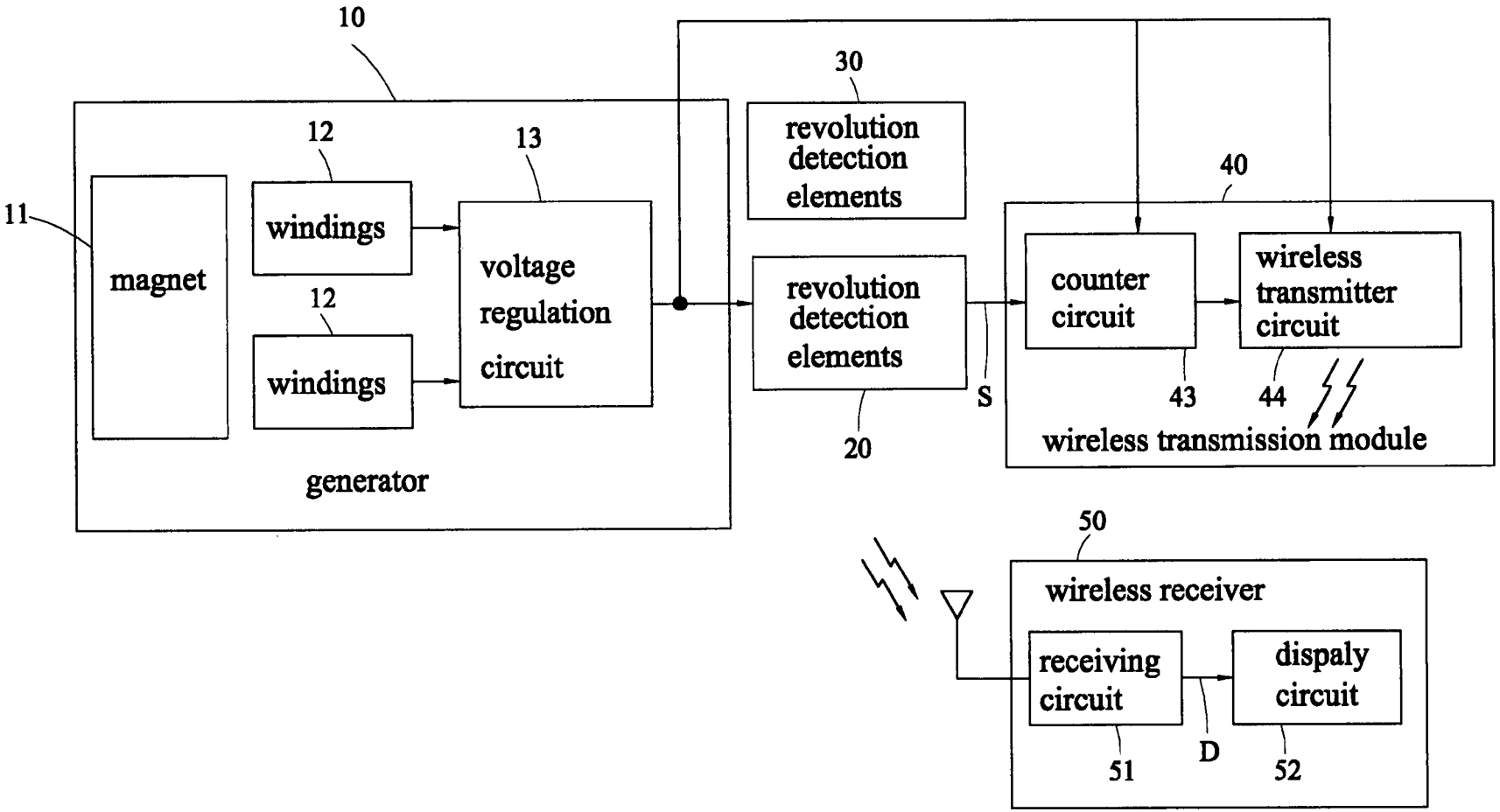
FIG. 5 is a block diagram of a circuit of the generator module, the wireless transmission module, and the wireless receiver of the wrist exerciser of the present invention.

Also referring to FIG. 5, the revolution counter 100 in accordance with the present invention comprises a generator module 10, at least a pair of revolution detection elements 20, 30, a wireless transmission module 40, and a wireless receiver 50. The generator module 10 comprises a magnet 11, electrical windings 12, and a voltage regulation circuit 13. The magnet 11 is mounted to an extension 233 formed on the retention ring 230 of the wrist exerciser 200. The windings 12 are arranged in the rotor 240 at a position opposing the magnet 11. In the embodiment illustrated, the generator module 10 is embodied as a circuit board fixed to, preferably inside a recess formed on the rotor 240. The windings 12 are arranged on the circuit board and oppose the magnet 11. Thus, when the rotor 240 rotates with the retention ring 230 kept stationary, electromagnetic reaction between the magnet 11 and the windings 12 induces an electrical voltage in the windings 12, which is applied to the regulation circuit 13, also formed on the circuit board, to provide a steady direct current output.

It is apparent that the generator module 10 can be of any known power generation arrangement, rather than the combination of magnet, electrical winding and regulation circuit, which provides steady direct current.

The revolution detection elements 20, 30 are mounted inside the casing of the exerciser 200 to detect the revolution of the rotor 240 that rotates inside the casing. In the embodiment illustrated in FIGS. 1-5, the two detection elements 20, 30 are a photo sensor and a reflector, respectively mounted to the circuit board of the generator module 10 and a lug 233A extending from the extension 233 of the retention ring 230 and opposing each other. Thus, when the rotor 240 rotates inside the casing, the photo sensor 20 emits a light beam toward the reflector 30 and receives a reflection beam from the reflector 30. This gives the photo sensor 20 counts of revolution of the rotor 240, and a revolution count signal S is generated in response thereto by the photo sensor 20. The photo sensor 20 is electrically coupled to and thus powered by the generator module 10.

The wireless transmission module 40 is mounted to the rotor 240, preferably at an opposite side of the rotor 240 with respect to the generator module 10. The wireless transmission module 40 is electrically connected to the regulation circuit 13 of the generator module 10 and the revolution detection element 20 by electrical wires 41, 42 to receive electrical power and the revolution count signal S from the generator module 10 and the photo sensor 20. The wireless transmission module 40 comprises a counter circuit 43 and a wireless transmitter circuit 44. The counter circuit 43 is coupled to the detection element 20 to receive the revolution count signal S and calculate revolution per minute (RPM) of the rotor 240 and/or total count of revolution of the rotor 240. The wireless transmitter circuit 44 is coupled to the counter circuit 43 to receive and then transmit the data regarding revolution counts to the wireless receiver 50 in a wireless manner. Apparently, the wireless transmission module 40 is not limited to that described above and can be replaced or substituted by any equivalents thereof.

The wireless receiver 50 comprises a receiving circuit 51 and a display circuit 52. The receiving circuit 51 receives the revolution count related data from the wireless transmitter circuit 41 of the wireless transmission module 40 and generates, in response thereto, a signal D corresponding to the data. The display circuit 52 is coupled to the receiving circuit 51 for receiving the signal D and then displaying the received signal D. Thus, the RPM of the rotor 240 or the total counts of the rotation of the rotor 240 is timely displayed. Apparently, the wireless receiver 50 is not limited to the circuit described above, and can be replaced or substituted by any equivalents.

Figure 6:
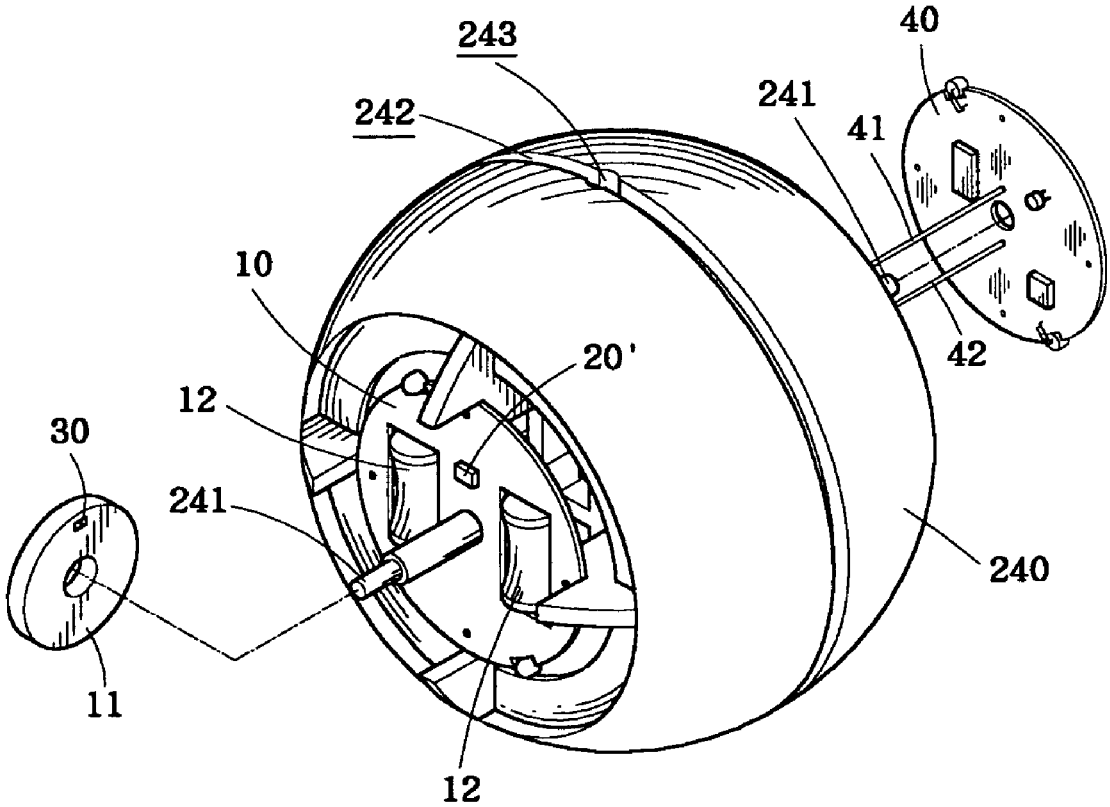
FIG. 6 is similar to FIG. 3 but showing a wrist exerciser in accordance with a second embodiment of the present invention.

Referring to FIG. 6, a second embodiment of the revolution counter 100 in accordance with the present invention is shown. The revolution detection elements 20, 30 are photo sensor and reflector respectively as mentioned previously. However, instead of being fixed to the retention ring 230, the reflector 30 of the second embodiment is mounted to the magnet 11, while the photo sensor 20 is stilled mounted to the circuit board of the generator module 10, but at a position opposing the reflector 30 that is on the magnet 11. Similar to the first embodiment, the rotation or revolution of the rotor 240 can be detected by the cooperation of the photo sensor 20 and the reflector 30. And again, a revolution count signal S is generated and associated data are transmitted to the wireless receiver 50.

Figure 7:
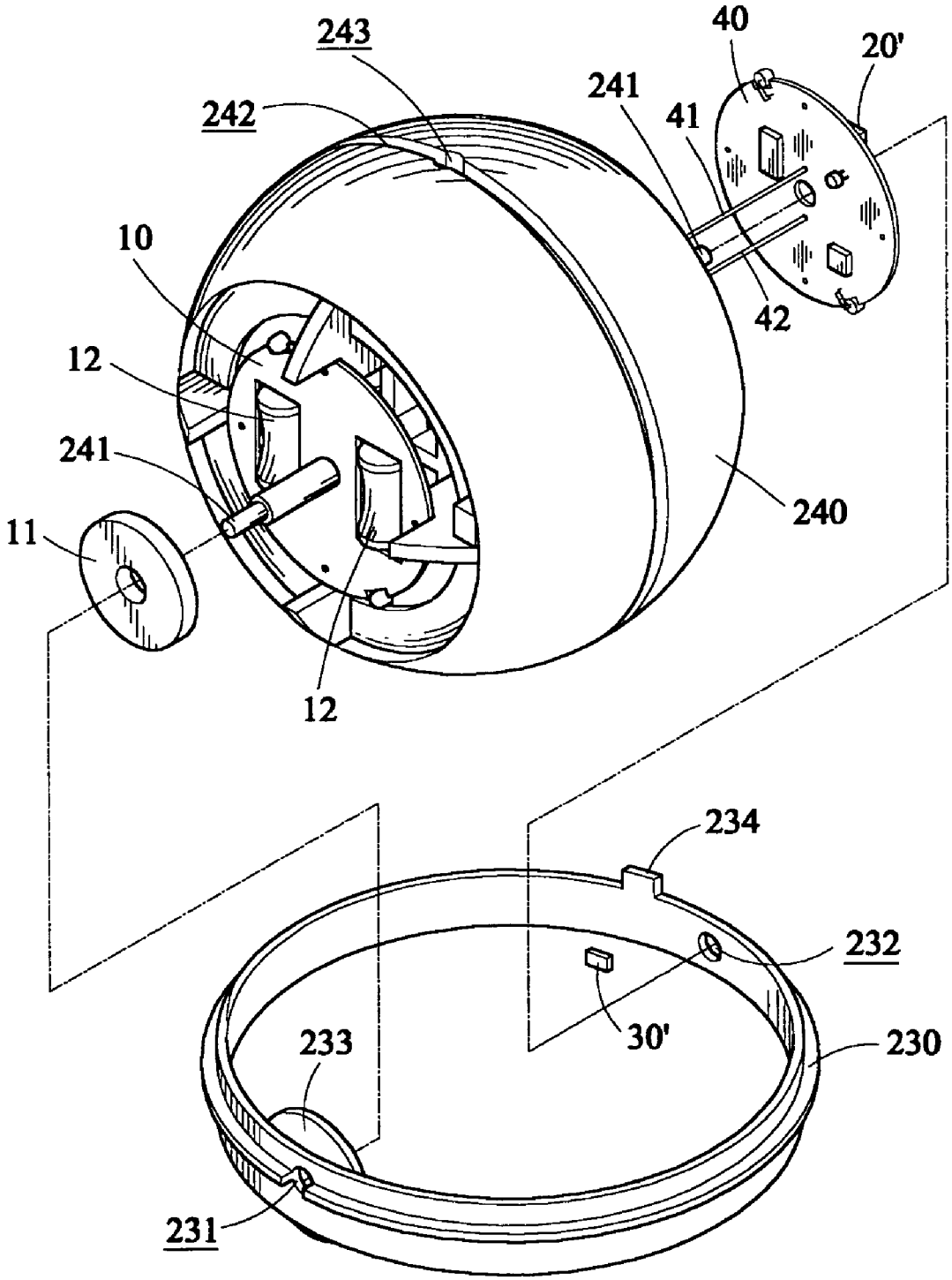
FIG. 7 is similar to FIG. 3 but showing a wrist exerciser in accordance with a third embodiment of the present invention.

Referring to FIG. 7, a third embodiment of the revolution counter 100 in accordance with the present invention is shown. The revolution detection elements of the third embodiment are a reed switch 20' and a magnet 30' respectively. The reed switch 20' is mounted to a circuit board of the wireless transmission module 40, while the magnet 30' is attached to the retention ring 230 of the wrist exerciser 200 at a position substantially opposing the reed switch 20'. Each time the rotor 240 carries the reed switch 20' to pass through the magnet 30', the reed switch 20' is trigger once. Consequently, a revolution count signal S is generated and data related to the revolution of the rotor 240 are transmitted to the wireless receiver 50

Figure 8:
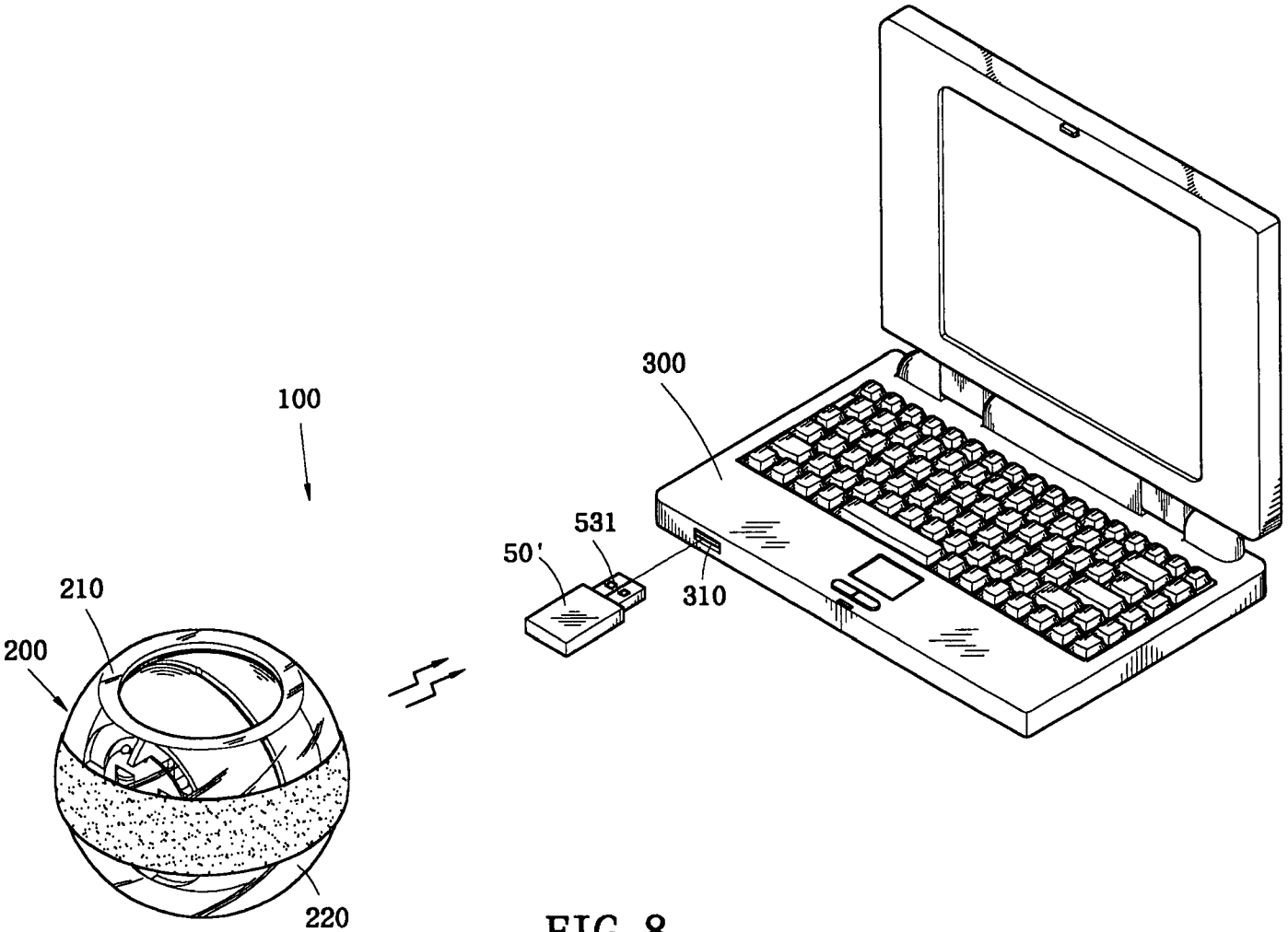
FIG. 8 is a perspective view showing a wrist exerciser in accordance with a fourth embodiment of the present invention, together with an external electronic device that receives revolution information from the wrist exerciser.
Figure 9:
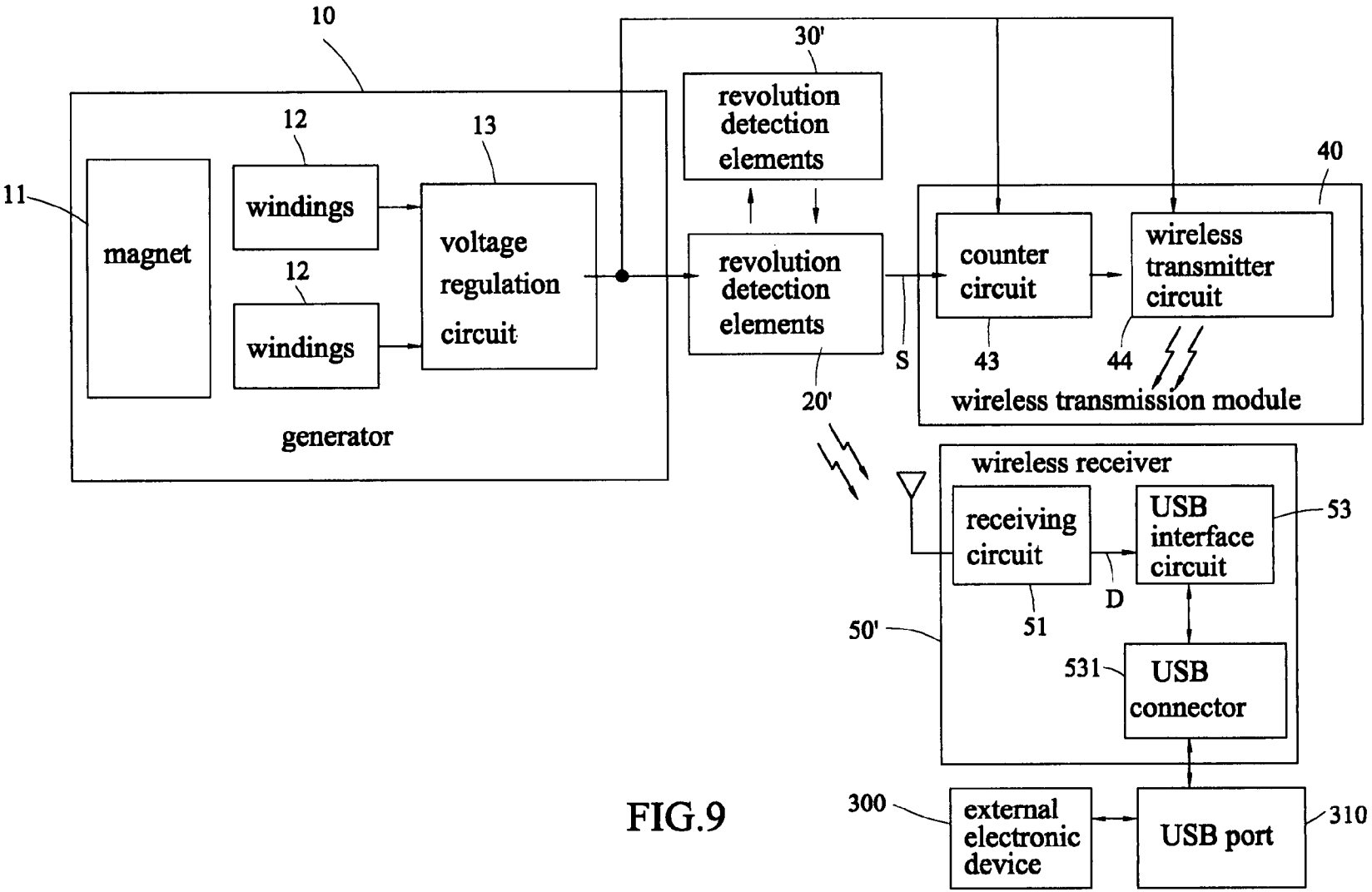
FIG. 9 is a block diagram of a circuit of the wireless receiver of the wrist exerciser illustrated in FIG. 8.

Referring to FIGS. 8 and 9, a fourth embodiment of the revolution counter 100 in accordance with the present invention is shown. In the fourth embodiment, the wireless receiver, which is now designated with reference numeral 50' for distinction, comprises a receiving circuit 51 and a universal serial bus (USB) interface circuit 53. The USB interface circuit 53 comprises a USB connector 531, which is engageable with a USB port 310 of an external electronic device 300, such as a notebook computer. The receiving circuit 51, in response to receipt of wireless signals carrying revolution related data of the rotor 240, generates a signal D, which is applied to the USB interface circuit 531, through which the signal D is transmitted to the electronic device 300. The revolution related data of the rotor 240, such as RPM and total counts of revolution, are processed and stored in the electronic device 300 for subsequent use, such as displaying and analysis.

The electronic device 300, which is shown as a notebook computer in the drawings, can be any known device capable to receive and process the revolution data of the rotor 240. Examples include mobile phones and personal digital assistants having USB interface.

Although the present invention has been described with reference to the preferred embodiments thereof, it is apparent to those skilled in the art that a variety of modifications and changes may be made without departing from the scope of the present invention which is intended to be defined by the appended claims.

What is claimed is:

1. A revolution counter coupled to a wrist exerciser comprised of a stationary casing and a rotor rotatably arranged inside the case, the revolution counter comprising:

a generator module arranged between the rotor and the casing to generate electrical power when the rotor is in rotation;

detection means arranged inside the wrist exerciser to detect revolution of the rotor and generate a signal in response to the detection, the detection means being electrically coupled to the generator module to be powered thereby;

a wireless transmission module connected to the generator module and the detection means to receive electrical power and the signal therefrom, and comprising means for determining data of revolution per minute and total count of the rotation of the rotor in response to the signal obtained from the detection means, and means for transmitting the data in a wireless manner; and a wireless receiver receiving the data transmitted from the wireless transmission module and coverting the data into a corresponding output signal.

2. The revolution counter as claimed in claim 1, wherein the generator module comprises:

a magnet mounted the casing of the wrist exerciser;

electrical windings mounted to the rotor and opposing the magnet to induce an electrical voltage due to relative rotation between the casing and the rotor; and a voltage regulation circuit, connected to the electrical windings to receive and process the voltage to generate a direct current output.

3. The revolution counter as claimed in claim 1, wherein the detection means comprises a photo sensor and a reflector.

4. The revolution counter as claimed in claim 1, wherein the detection means comprises first and second portions respectively mounted to the wireless transmission module and the casing.

5. The revolution counter as claimed in claim 1, wherein the detection means comprises a reed switch and a magnet.

6. The revolution counter as claimed in claim 1, wherein the detection means comprises first and second portions respectively mounted to the generator module and the casing.

7. The revolution counter as claimed in claim 1, wherein the wireless transmission module comprising:

a counter circuit receiving the signal from the detection means and determining the data of rotation of the rotor; and a wireless transmitter circuit connected to the counter circuit for receiving the data and transmitting the data in a wireless manner.

8. The revolution counter as claimed in claim 1, wherein the wireless receiver comprising:

a receiving circuit receiving the data from the wireless transmission circuit and converting the data into the output signal; and a display circuit receiving the output signal and displaying the data associated with the output signal.

9. The revolution counter as claimed in claim 1, wherein the wireless receiver comprising:

a receiving circuit receiving the data from the wireless transmission circuit and converting the data into the output signal; and a USB interface connecting to the receiving circuit to receive the output signal and converting the output signal into a USB interface signal.

10. The revolution counter as claimed in claim 9, wherein the USB interface comprises a connector for outputting the USB interface signal.

* * * * *